United States Patent [19]

Tominari et al.

[11] Patent Number: 4,524,745

[45] Date of Patent: Jun. 25, 1985

[54] ELECTRONIC CONTROL FUEL INJECTION SYSTEM FOR SPARK IGNITION INTERNAL COMBUSTION ENGINE

[75] Inventors: Noboru Tominari, No. 19-9, Kamiyama-cho, Shibuya-ku, Tokyo; Takashi Ishida, Kanagawa, both of Japan

[73] Assignees: Mikuni Kogyo Co., Ltd.; Noboru Tominari, both of Tokyo, Japan

[21] Appl. No.: 538,843

[22] Filed: Oct. 5, 1983

Related U.S. Application Data

[63] Continuation of Ser. No. 228,973, Jan. 27, 1981, abandoned.

[30] Foreign Application Priority Data

Jan. 31, 1980 [JP] Japan ..... 55-10218

[51] Int. Cl.[3] ..... F02D 5/00

[52] U.S. Cl. ..... 123/478; 123/399; 123/415; 123/416; 123/489; 123/494; 123/571

[58] Field of Search ..... 123/494, 478, 399, 445, 123/361, 350, 489, 360, 571, 415, 416, 417, 480

[56] References Cited

U.S. PATENT DOCUMENTS

| | | | |
|---|---|---|---|
| 2,330,650 | 6/1940 | Weiche | 261/50 |
| 3,575,147 | 4/1971 | Harrison et al. | 123/494 |
| 3,750,632 | 8/1973 | Zechnall | 123/488 |
| 3,771,504 | 11/1973 | Woods | 123/444 |
| 3,916,854 | 11/1975 | Barton et al. | 123/360 |
| 3,983,848 | 10/1976 | Handtmann et al. | 123/494 |
| 4,091,773 | 5/1978 | Gunda | 123/491 |
| 4,112,885 | 9/1978 | Iwata et al. | 123/361 |
| 4,138,979 | 2/1979 | Taplin | 123/445 |
| 4,159,697 | 7/1979 | Sweet | 123/492 |
| 4,168,679 | 9/1979 | Ikeura et al. | 123/399 |
| 4,195,604 | 4/1980 | Taplin | 123/571 |
| 4,289,108 | 9/1981 | Shioyama | 123/571 |

OTHER PUBLICATIONS

Engine Air Control—Basis of a Vehicular Systems Control Hierarchy by Donald L. Stivender, 1978, Society of Automotive Engineers, Inc.

A Fluidic Fuel-Injection System Utilizing Air Modulation, by R. L. Woods, 1973, American Society of Mechanical Engineers, New York.

*Primary Examiner*—Andrew M. Dolinar

*Attorney, Agent, or Firm*—Stevens, Davis, Miller & Mosher

[57] ABSTRACT

An electronic control fuel injection system for a spark ignition internal combustion engine is described which controls air flow rate as function of fuel flow rate by transmitting an operator's depression stroke of an accelerator pedal to a fuel selecting mechanism which determines the fuel flow rate, applying a signal representative of the selected fuel flow rate to a computer together with various correction information, calculating by the computer from the selected fuel flow rate and correction information, the optimum air flow rate, and determining the opening of a throttle valve from the calculated result via a throttle valve servo mechanism. The invention is particularly useful in eliminating hesitation of an automobile while attaining both fuel economy and low harmful exhaust emissions.

13 Claims, 15 Drawing Figures

ELECTRONIC CONTROL FUEL INJECTION SYSTEM FOR SPARK IGNITION INTERNAL COMBUSTION ENGINE

This application is a continuation of application Ser. No. 228,973, filed Jan. 27, 1981, now abandoned.

BACKGROUND OF THE INVENTION

This invention relates to an electronic control fuel injection system for a spark ignition internal combustion engine and, more particularly, to a technique for electronically controlling the fuel injection system for controlling the air flow rate as a function of fuel flow rate.

From the advent of the internal combustion engine to recent times, a carburetor has generally been used to supply air and fuel to the combustion chamber of a spark ignition internal combustion engine. Although a carburetor is recognized as being a superior device for adjusting an air/fuel mixture from the viewpoint of its cost performance, it is too complicated to accurately perform some of the precise adjustments needed in supplying fuel to an automotive engine. Particularly, the carburetor alone is unsuited for satisfying the demands of both fuel economy and low exhaust emissions and it is typically assisted by a fluidic correcting device, an electronic correcting device or a combination of the two for providing various air/fuel mixture correcting functions.

As an improvement over the carburetor, the Bendix Corporation has developed and widely sold an electronic control fuel injection system (EFI) which utilizes modern electronic techniques to adjust the air fuel mixture. In this system, a carburetor is not used to manage the air fuel ratio, but rather an electronic circuit is used to develop a control signal representative of the air fuel ratio which meters fuel delivery with an electronic actuator. This system takes into consideration a variety of factors in order to satisfy requirements of environmental conditions, emission levels, load performance, and fuel economy. Even though more expensive than a conventional carburetor, this system is widely used because of its many other advantages.

However, in both a carburetor and this EFI system, the air fuel ratio of the fuel mixture supplied to the engine is controlled by an operator's depression of an accelerator pedal to open or close an intake air throttle valve attached to the engine. Both select the air flow rate by this depression, suitably detect the intake air flow rate, and determine the fuel flow rate in balance with the air flow rate. That is, the air flow rate is selected preferentially as an initial value, and the fuel flow rate is then calculated as a function of the air flow rate.

However, it has been found that a conventional air preferential system cannot obtain both fuel consumption economy and clean combustion under all operating conditions of an engine. More specifically, it is different to achieve consistent fuel economy and a desired low emission density because the operating mode of a throttle valve with respect to the transient operation of the engine and the fuel flow rate pattern determined according to the operating mode of the throttle valve, as well as the time history of the air fuel ratio (A/F) at any given instant, all affect fuel economy and emission density and the driving performance of an automotive vehicle, and they often interfere with each other. For this reason, it is substantially difficult to achieve compatibility among these factors. Because the air flow rate, which is selected initially by the operator, is frequency varied stepwisely as desired, and since the air density is much lower than fuel density, a carburetor can more quickly change the air flow rate than the fuel flow rate so that the air called for at a selected air fuel ratio reaches the engine before the fuel change associated with the selected air fuel ratio. Further, in an accelerating state of the engine, the differential pressure between the front side and the rear side of the throttle valve operating as an intake air control valve becomes large up to the time when it is stepwisely varied, so that a great deal of air flows into the throttle valve at the initial time of stepwise change of the valve. Both situations result in a lean air fuel mixture. Accordingly, it is necessary to correct an excessively lean air fuel mixture ratio by adding a great deal of fuel to maintain the air fuel mixture in the combination chamber of the engine within a desired combustible range. If the correction is insufficient, the automobile's driving performance deteriorates, while if the correction is excessive, fuel economy and emission density deteriorate. Thus, the amount added is very critical.

In the case of steping down the throttle (releasing the accelerator), an opposite phenomenon occurs which has similarly critical characteristics.

Because of above problems, the air flow rate preference which has been widely adopted is of doubious value, and it is accordingly now considered better to have a fuel preference system. A good comparison between the two different systems is disclosed in Paper No. 780346 of the Society of Automotive Engineers by D. L. Stivender entitled "Engine Air Control—Basis of a Vehicular Systems Control Hierarchy."

A basic fuel preference system was initially disclosed in a U.S. Pat. No. 3,771,504 entitled a "Fluidic Fuel Injection Device Having Air Modulation", and reported in Paper No. 78-WA/DSC-21 of the American Society of Mechanical Engineers (ASME) entitled "An Air Modulated Fluidic Fuel Injection System" with respect to actual experiments conducted on the system. The fundamental concept disclosed in this patent and the report is to control the air fuel ratio as a function of the fuel flow rate in the fuel preference system by carrying out the detection, computation and actuation of the system by a pneumatic and/or fluidic circuit. This system has a good cost performance when compared with a conventional carburetor.

While this system significantly improves control over the air fuel ratio, particular during transient engine operations, since the system is essentially carried out with fluidic control, its response is somewhat slow to changing operator input, and the operating range over which adjustments in the air flow and fuel flow rate can be obtained is somewhat limited. This in turn limits the ability of the system to properly operate under all possible operating states of an engine. Also the system cannot compensate or "fine tune" the selected fuel flow rate or air flow rate to finely adjust the air fuel ratio in accordance with compensation factors determined by engine operating conditions, and cannot satisfactorily accommodate the often conflicting requirements of fuel economy and low emissions.

SUMMARY OF THE INVENTION

A primary object of this invention is to provide a closed loop electronic control fuel injection system for a spark ignition internal combustion engine which eliminates the aforementioned drawbacks and disadvantages of the conventional fuel injection system and controls the air flow rate to an engine as a function of the fuel flow rate.

Another object of this invention is to provide a closed loop electronic control fuel injection system for a spark ignition internal combustion engine which controls the optimum air flow rate by actuating the throttle valve according to results calculated by a computer from an operator selected fuel flow ratio and various other information such as coolant temperature or engine cylinder head temperature, atmospheric temperature, atmospheric pressure, and oxidation and/or reducing catalytic temperature.

Yet another object of this invention is to provide a closed loop electronic control fuel injection system for a spark ignition internal combustion engine which can control the air flow rate so that the air fuel mixture becomes rich immediately after acceleration and lean immediately after deceleration of the engine or automobile while still achieving both fuel economy and low emissions. This is achieved by selecting a proper transient air fuel mixture.

Still another object of this invention is to provide a closed loop electronic control fuel injection system for a spark ignition internal combustion engine which can significantly improve the fuel consumption and emission density even in repeated slow and steady operating states of acceleration and deceleration, as in city traffic, by rapidly controlling the air flow rate as a function of the fuel flow rate following an operator's movement of an accelerator.

In accordance with this invention, the electronic control fuel injection system transmits the operator's depression of an accelerator pedal through a mechanical and/or electrical linkage to a fuel selecting mechanism (such as a metering mechanism) to thereby determine a fuel flow rate, detects, electrically the fuel flow rate as an electric signal, applies the signal to a computer, also applies various information such as engine rotational speed, coolant temperature of the engine, cylinder head temperature, atmospheric temperature, atmospheric pressure, oxidation and/or reducing catalytic temperature, etc. as similar electric signals to the computer to correct the air flow rate to maintain an accurate operating state, refers in the computer to preprogrammed data defining the functional relation among these parameters, calculates and corrects the optimum air flow rate from these parameters as a function of the fuel flow rate input at any given time, produces an electric signal for determining the opening of a throttle valve and consequently the air flow rate from the calculated result, and applies the electric signal to a throttle valve servo mechanism to thereby actuate the throttle valve so as to set the optimum air flow rate.

BRIEF DESCRIPTION OF THE DRAWINGS

The above and other relates objects and features of the invention will be apparent from a reading of the following description of the disclosure found in the accompanying drawings in which.

DESCRIPTION OF THE PREFERRED EMBODIMENTS

Figure 1:
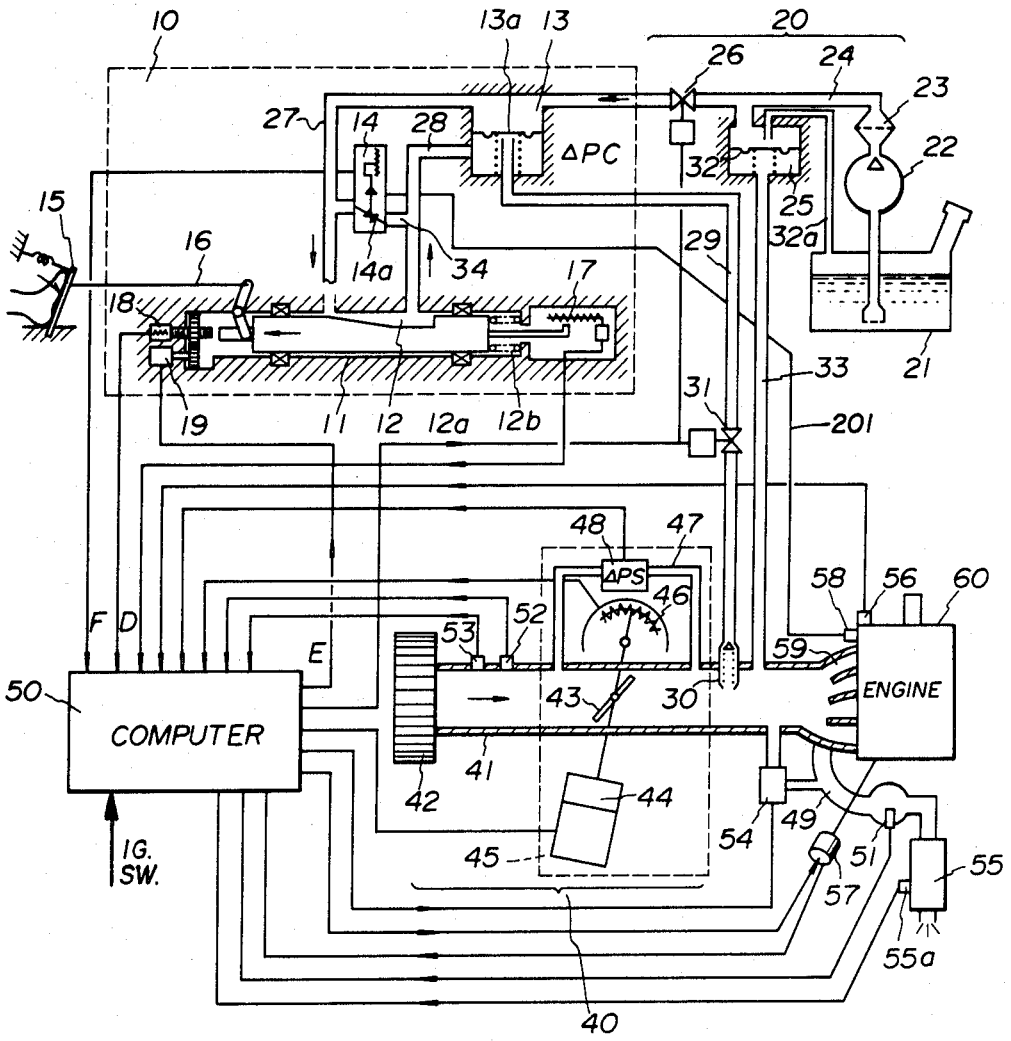
FIG. 1 is a block diagram of the electronic control fuel injection system for a spark ignition internal combustion engine constructed according to the present invention.

Reference is made to the drawings, and particularly to FIG. 1 which shows one preferred embodiment of the electronic control fuel injection system for a spark ignition internal combustion engine constructed according to this invention, which comprises essentially a fuel subsystem containing a fuel metering mechanism, an air flow subsystem containing a throttle valve servo mechanism, a control unit (an electronic computer), and a correcting element having four main elements.

Each of the elements will now be described in detail.

I. Fuel Subsystem

The fuel subsystem comprises a metering mechanism 10 and a fuel supply subsystem 20. The metering mechanism 10 consists of a spool valve 12 telescopically inserted into a cylinder 11, a differential pressure chamber 13 divided into upper and lower chambers, an engine cold starter 14, a link 16 for converting the movements of an accelerator pedal 15 into displacement of the spool valve 13, a metering spool potentiometer 17 provided at the end of the cylinder 11, and a limiter potentiometer 18 provided at the end of the cylinder 11. The spool valve 12 has a tapered cutout groove 12*a* over its length between the fuel inlet and the outlet ports as will be hereinafter described in greater detail. A coil spring 12*b* is compressed at the end side of spool valve 12 for urging the spool valve 12 toward the opening direction. The potentiometer 18 incorporates a limiter servo motor 19 attached thereto for controlling the opening limit position of the spool valve 12.

The fuel supply subsystem 20, as shown in FIG. 1, consists of a fuel tank 21, a fuel pump 22, a filter 23, a passage 24, a relief valve or regulator such as pressure control valve 25, a stop valve 26 provided in the passage 24, a passage 27 introduced from the delivery side of the stop valve 26 through the upper chamber of the differential pressure chamber 13 to the inlet port of the cylinder 11, a passage 28 introduced from the outlet port of the cylinder 11 to the lower chamber of the differential pressure chamber 13, a passage 29 introduced from the output port of the differential pressure chamber 13 to an injector 30 provided in an intake manifold bore 41, and a stop valve 31 interposed in the passage 29. The pressure control valve 25 is, as shown in FIG. 1, divided by a diaphragm 32 into upper and lower chambers, the upper chamber containing a passage 32*a* for returning the fuel to the fuel tank 21, and the lower chamber containing a vacuum passage 33 for operating the diaphragm 32 by the vacuum in the intake manifold bore 41. The midpoints of the passages 27 and 28 are branched to form a shorting passage 34, the opening of which is controlled by the engine cold starter 14. The engine cold starter, in response to increasing engine temperature, progressively closes passage 34. Thus, for cold starting passage 34 is open, while it is essentially closed once the engine reaches a proper operating temperature. Line 201 represents the temperature sensing coupling of the cold starter 14 to the engine cylinder head, for example a heat pipe device.

II. Air Flow Subsystem

The air flow subsystem 40 comprises an air cleaner 42 mounted at the end of the intake manifold bore 41, a throttle valve 43, and a servo motor 44 for positioning the throttle valve. The throttle valve 43, the servo motor 44 and potentiometer 46 and a differential pressure gauge 48 as will be described in greater detail, form an air flow controller 45.

III. Control Unit

The control unit, which will hereinafter be called a "computer", 50 may consist of an analog computer or a digital computer, the latter comprising a microprocessor, an input/output interface and a memory. This unit controls the opening of the throttle valve in responsive to the operator selected fuel injection amount, and varies correction factors as described below. It can also control the ignition timing and exhaust gas recirculation operating state of the engine as also described below.

IV. Correcting Element

The correcting element consists of a potentiometer 46 for detecting the opening of the throttle valve 43, a differential pressure gauge 48 provided in the passage 47 introduced from the intake bore 41 at the front and the rear sides of the throttle valve 43, an oxygen sensor 51 provided in an exhaust manifold 49, an intake air temperature sensor 52, an absolute atmospheric pressure sensor 53, a cold starter 14 containing internally the controller and a changeover valve, an engine coolant temperature sensor 56, an ignition timing controller 57, and an engine cylinder head temperature sensor 58. Further, in addition to the above, there can be added to the electronic control fuel injection system an EGR control valve 54, a catalytic converter 55, and a reducing catalytic temperature sensor 55*a*.

In FIG. 1, reference numeral 59 illustrates an intake manifold, and 60 a spark ignition internal combustion engine.

As shown in FIG. 1, the elements in the above paragraphs IV are electrically connected to the computer and its related components. In FIG. 1, D is an output signal fed from the spool potentiometer 17 to the computer 50 representing an operator selected fuel flow rate, E is an output signal fed from the computer 50 to the limiter servo motor 19 for limiting the operator selected fuel flow rate, and F an output signal fed from the limiter potentiometer 18 to the computer 50 representing the actual fuel limiting position of a limit element.

Operation:

The operation of the configuration thus constructed above will now be described in detail.

When an operator depresses the accelerator pedal 15, the link 16 moves the cylindrical spool valve 12 having tapered cutout groove 12*a* leftwardly in the cylinder 11 of the metering mechanism 10. Accordingly, the fuel fed from the passages 24 and 27 flows from the inlet port to the cutout groove 12*a* and through the output port into the passage 28 and then into the differential pressure chamber 13. At this time, the fuel flow rate is determined by the area of the opening formed by the inlet port and the cutout groove 12*a*. Since the differential pressure chamber 13 produces the fuel at the differential pressure $\Delta PC$ at the front side and the rear side of the orifice of the opening between the upper chamber and the lower chamber thereof, it is always retained constant regardless of the magnitude of the area of the opening of the inlet port of the cylinder 11. Thus, the metering fuel is introduced through the passage 29 into the injector 30, and injected into the intake manifold 59 at the air intake port, and thus applied into the combustion chamber of the engine 60, after being mixed with the intake air. Simultaneously, the metering spool potentiometer 17 detects the displacement of the spool 12 and feeds the detected output into the computer 50 as a fuel rate signal D.

The computer receives the fuel rate signal as well as a variety of information in the form of voltage, current, digital signal and/or frequency signal or the like from the sensors as described in the above paragraphs II and IV, interrelates them in accordance with their functional relation to the air flow rate, computes the optimum or desired air flow rate at any given time, and outputs the results in the form of an electric signal to the throttle valve servo motor 44 of the air flow controller 45 to thereby drive the servo motor 44 so as to obtain a proper throttle position. In the meantime, the differential pressure gauge 48 always detects the pressure difference between the front side and the rear side of the throttle valve in the form of the signal $\Delta PS$, and computer 50 continuously computes the optimum or desired value of the air flow rate and thus the throttle opening needed to achieve it by the signal $\Delta PS$ representing the actual air flow rate and the signal of the throttle valve position $\theta$ detected simultaneously by the throttle valve potentiometer 46 representing actual throttle position, to thus feed a command output to the servo motor 44.

Figure 15:
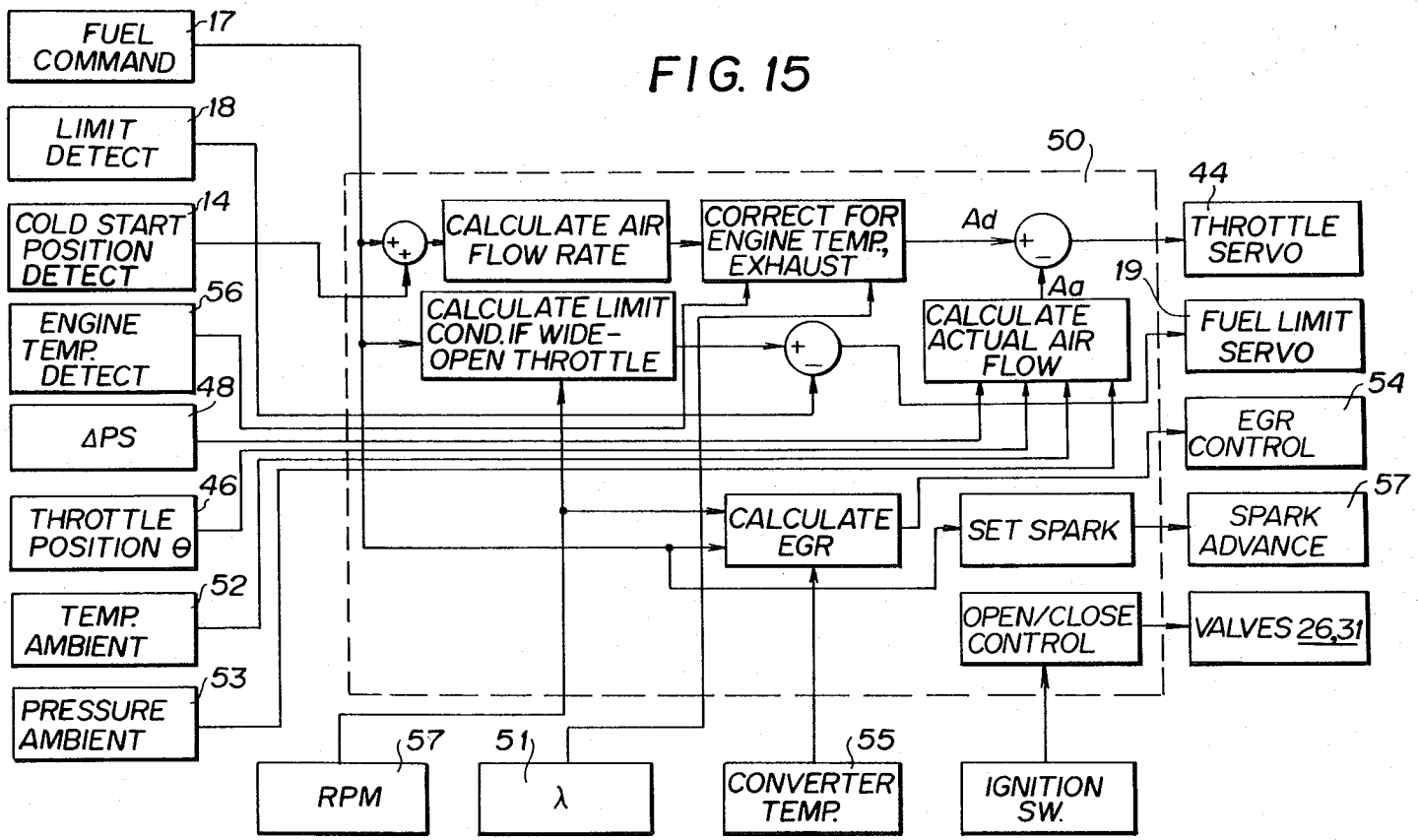
FIG. 15 is a signal flow diagram showing operation of the computer illustrated in FIG. 1.

FIG. 15 illustrates in greater detail the signal processing and computation performed by computer 50. A fuel command signal D from potentiometer 17 is inputed to the computer which calculates therefrom an initial air flow rate to establish a proper air fuel ratio for the engine. The calculation of the initial air flow rate can be performed using an arithmetic device or in the case of a digital computer, may be a table look up function in which various air flow rate values are stored in accordance with various input fuel commands. After initially calculating the air flow rate the calculated air flow rate is corrected for engine temperature in accordance with the engine temperature detection signal applied from sensor 56. This correction creates a slight offset in the air flow rate initially calculated. After correction of the air flow rate signal it is combined subtractively with an actual air flow rate signal which is calculated by the computer from the ΔPS signal received from sensor 48 and the throttle opening position signal $\theta$ received from sensor 46. Additional refinements in the calculated actual air flow can be made when ambient temperature is inputed into the calculation by a sensor 52 and ambient pressure is inputed by a sensor 53. The difference between the desired air flow rate $A_d$ calculated by the computer and the actual air flow rate $A_a$ which is also calculated by the computer is used as an output signal to drive the throttle servo 44 to a desired position. As with the intial air flow rate calculation, both the correction for engine temperature and calculation of actual air flow rate can likewise be, when a digital computer is used, a stored scheduling table in which a predetermined output value is indicated for predetermined combinations of input signals for the various parameters.

In lieu of a stored program/data digital computer, e.g., a microprocessor and associated interface and memory, the computer 50 can be an analog computer which computes the required output by calculating analog values using an electronic circuit. For the digital computer implementation, analog signals from the various sensors may be converted through an A/D converter into digital outputs, and calculated by the computer in an arithmetic section thereof and the computer outputs can be converted through a D/A converter into an analog vaue to thereby drive an analog servo motor of the throttle servo element. If a stepping motor is used to drive the throttle valve, it can be driven as a servo motor without D/A conversion, or a bang-bang control can be used together with an inexpensive DC motor. The throttle valve may be readily set at a desired opening by any of these known methods.

The computer 50 may not only determine the opening of the throttle valve, but can also produce an EGR rate command, and a spark advance command to ensure smooth engine performance, fuel economy and desired emission density.

EGR rate control is effected by the computer by calculating an EGR control signal which is applied to EGR control valve 54 in accordance with applied signals from the RPM sensor (distributor 57) and the fuel command input (at 17). The temperature of the catalytic converter is also imputed into the calculation from sensor 55. As a result of the calculation of the exhaust gas rate necessary depending on those various parameters, an output signal is formulated which is applied to EGR control valve 54 to suitably controlled exhaust gas recirculation to attain a desired low emissions level. When a catalytic converter is used in the engine which requires a substantially stoichiometric engine air fuel ratio for proper operation, a signal form the oxygen sensor 51 can also be applied in the basic air rate calculation performed by the computer to provide a suitable offset to insure that a substantially stoichiometric air fuel ratio will be obtained by the applied optimum air field rate signal applied to throttle valve 44. This is illustrated in FIG. 15 by the output of sensor 51 being applied to the correction calculation which produces the air flow signal $A_d$.

The spark advance control is also illustrated in FIG. 15. In this case, the fuel command signal from sensor 17 is applied to a spark advance control circuit which forms a spark advance signal applied to distributor 57. This control circuit also establishes predetermined timing advance for predetermined levels of the applied fuel command signal 17 and accordingly, as in the discussion above, the spark advance control can be carried out as a look up table containing timing corrections for various levels of fuel command signal which is stored in a computer 50.

As illustrated in the lower right hand portion of FIG. 15, the computer also can formulate an open and close signal for the valves 26 and 31. These valves are provided to positively stop the flow of fuel when the engine is off. Accordingly, the computer receives a signal from, for example the ignition switch, indicating the engine is on or off and appropriately applies a control signal to open valves 26 and 31 when the engine is on and close the valves when the engine is off.

From an idling operation to a partially loaded state of the engine, the depression stroke of the accelerator pedal by an operator moves at a ratio of 1:1 to the displacement of the spool valve, however in the range where the throttle is widely opened in a heavy load condition of the engine, the displacement of the spool valve is restricted as described below in order to limit the fuel flow rate. That is, the spool valve has a full stroke so as to provide a fuel flow rate required for a maximum engine speed when the throttle is widely opened. Accordingly, in case where the engine speed is not at maximum, that is, for a 6,000 rpm maximum, for example, where the engine is rotated at 3,000 rpm, if the spool valve is displaced to its full stroke at a ratio of 1:1 of the depressed stroke of the accelerator in response to the full throttle opening command by the operator, the fuel flow rate supplied to the engine becomes twice the required fuel flow rate to cause the air fuel mixture to have an overenriched air fuel ratio. As a result, it introduces abnormal engine performance with excessive emission density.

Therefore, the displacement of the spool valve must be restricted. In order to solve this problem, the computer 50 formulates a fuel rate limit control signal from the inputted fuel rate signal D and engine RPM (FIG. 15). This limit control signal represents an appropriate restriction of the displacement of the spool valve 12 leftwardly to ensure that for any given RPM, an excessive amount of fuel is not supplied to the engine. This limit control signal actuates the limiter servo motor 19 attached to the left side end of the spool valve 12 (See Fig. 1). This fuel limiting calculation (shown in FIG. 15) can also be in the form of a look up function in a table of stored limit values verses various RPM values. At this time, the limiter potentiometer 18 detects the actual limiting position of the servo motor 19 and feeds back the detected signal to the computer 50 which adjusts the limiter servo motor 19 to the accurate limiting position calculated for the servo motor 19. Thus, even when the throttle valve is fully opened, the limiter servo motor 19 and the limiter potentiometer 18 is always ensure that more fuel than necessary to achieve an adequate air fuel ratio (A/F) is not supplied to the engine even in any state of the engine due to the wide open throttle and to the excessively depressed stroke of the accelerator pedal by the operator.

The engine cold starter 14, may accomodate a bypass valve 14*a* which opens shorting passage 34 between the inlet and the outlet of the metering spool 12 upon operation, for example, of a thermowax capsule in response to the coolant temperature or the engine cylinder head temperature and the atmospheric temperature as detected by the sensors 56, 58 and 52.

The opening of the bypass valve 14*a* is detected by a potentiometer in the same manner as the limiter potentiometer 18 or the metering potentiometer 17, and the detected signal is fed back to the computer 50, which uses it, during cold starting as the fuel flow command in calculating the air flow signal $A_d$ which is output to the servo motor 44 to obtain a suitable opening thereof. It is noted that the bypass valve 14*a* of the cold starter 14 may also be replaced by a servo motor, pulse motor or a pneumatic actuator or the like in the same manner as the limiter servo motor 19 or the throttle valve servo motor 44 without using the thermowax capsule. These actuators may drive the valve by the output command from the computer 50 as computed by the signal from the coolant temperature sensor 56, but the details thereof will be omitted for the purpose of simplifying the description.

Referring back to FIG. 1, which shows the relationship among the respective subsystems of one preferred embodiment of the present invention, the injector 30 is disposed at the downstream side of the throttle valve 43, but the injector 30 may also be disposed upstream of the throttle valve, but in this case the detected value of the differential pressure ΔPS may slightly vary due to the adverse effect of the atomized fuel and the vacuum fuel at the front and the rear sides of the throttle valve to thereby lower the sensing accuracy of the air flow rate accordingly. It is also noted that the single point injection may be replaced by the so-called multiple point injection to inject the fuel into several cylinders by slightly modifying the interior of the metering mechanism 10.

Modification of Metering Mechanism:

Construction and Operation of Preferred Other Embodiments

Figure 13:
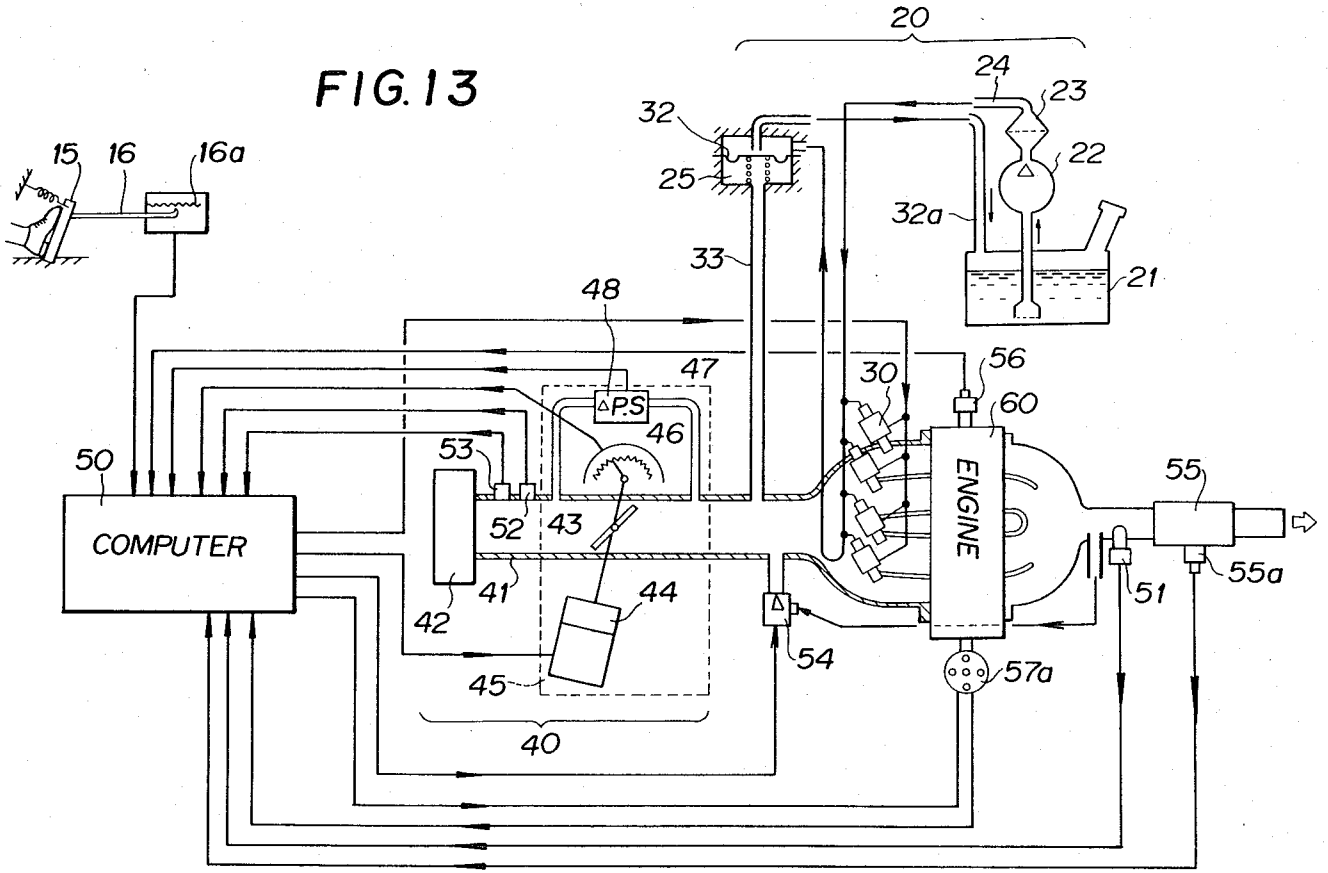
FIG. 13 is a block diagram of another preferred embodiment of the electronic control fuel injection system of the present invention shown in FIG. 1.
Figure 14:
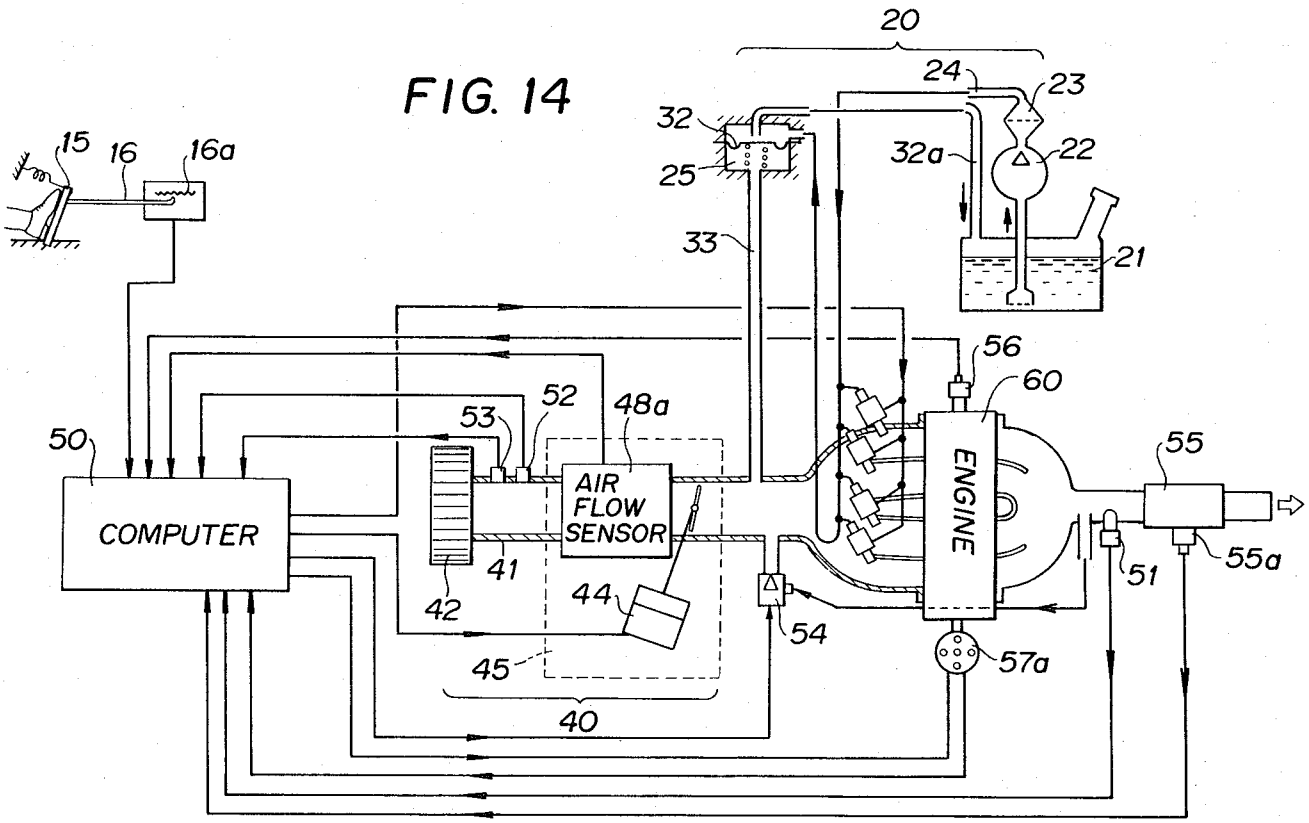
FIG. 14 is a block diagram of still another preferred embodiment of the electronic control fuel injection system of the present invention shown in FIG. 1.

FIGS. 13 and 14 show other preferred embodiments of the electronic control fuel injection system of the present invention.

I. Fuel Subsystem

In these embodiments the fuel flow rate is metered by computer 50 which first calculates a required fuel flow rate and then calculates an optimum air flow rate. Fuel is supplied through a pump 22 and a filter 23 to a plurality of solenoid valve type injectors 25 mounted at the intake ports of the respective cylinders of an engine 60. Excessive fuel is introduced to a relief valve 25 so set that the fuel pressure in the injector line may always become a predetermined constant pressure. The fuel injection amounts from the respective injectors 30 are controlled by a computer 50 which receives the output of a potentiometer 16*a* connected to the end of a rod 16 of an accelerator pedal 15, corrects for various factors such as, for example, temperature, intake air absolute pressure, etc. and determines the time duration of opening the valves of the respective injectors 30 to achieve a desired fuel flow rate. The computer 50 may also set the maximum time duration for opening the valves of the respective injectors 30 with reference to the engine rotational speed or number of revolution per minute of the engine to thereby limit the fuel flow as in the previous embodiment. In this case, the fuel injection signal patterns applied to the respective injectors 30 can control flow rate in accordance with an engine rotational speed trigger, an ON time duration control having a predetermined frequency with variable pulse width, a fuel flow rate control with frequency modulation of a constant ON time duration, or a composite control pattern using the latter two techniques.

II. Air Flow Subsystem

An air flow subsystem 40 shown in FIG. 13 incorporates the same construction as shown in FIG. 1. An air flow subsystem 40 shown in FIG. 14 comprises a conventional air flow sensor 48*a* for an electric output (DC output) proportional to the intake air amount, or Kármá vortex or supersonic frequency variation output instead of differential pressure air flow sensing. Reference numeral 57*a* represents a distributor which contains an engine rotational speed sensor and an ignition timing controller.

III. Control Unit

The computer 50, after calculating the fuel flow rate, receives the air flow rate sensed by the aforesaid air flow subsystem, calculates it with various correction signals simultaneously received and instructs and optimum throttle angle to a servo motor 44 as in the embodiment in FIG. 1.

*Throttle Servo Subsystem

The servo motor 44 in a throttle servo mechanism may be a DC servo motor, but a stepping motor can advantageously be used. The stepping motor can set a stepping angle of $(\frac{1}{2})^n$ knurl with gears attached by suitably reducing the knurl (which is the rotating angle of one step of the motor) or suitably selecting the drive type of the motor. Therefore, the stepping motor can secure smooth operation with a sufficiently small stepping angle.

*Starting Subsystem

The embodiments shown in FIGS. 13 and 14 employ the same starting subsystem as shown in FIG. 1, however, a separate starting subsystem such as illustrated in FIG. 1 is not necessary, as will be described below.

Since the computer 50 always receives various correction factors such as, for example, atmospheric pressure, temperature, engine coolant temperature, etc., it can calculate the time duration of opening the injectors 30 to increase or decrease the time duration in accordance with these correction factors and to also simultaneously operate the stepping motor or DC servo motor to suitably determine the air flow rate. Therefore, when starting a cold engine and warming up the engine, the computer 50 may set a sufficient cold starting and warm-up air flow rate and air fuel mixture ratio A/F merely by its programming without any additional mechanism. That is, the computer can be programmed with a starting or warm up pattern or can correct other factors of the engine in any state and drive the actuators to achieve desired results.

Although the emnbodiments shown in FIGS. 13 and 14 employ respective injectors for the cylinders, a single injector may be amounted in the intake manifold bore 41 immediately after the throttle valve 43 to inject the fuel as shown in FIG. 1. Further, the respective injectors 30 may be replaced with fluid flow valves shown in FIG. 9, which, in effect, function as the injectors 30.

Reference is made now to FIGS. 2 to 8, which show another preferred embodiment of the metering mechanism used in the electronic control fuel injection system of this invention which employs a rotary valve instead of the spool valve.

Figure 2:
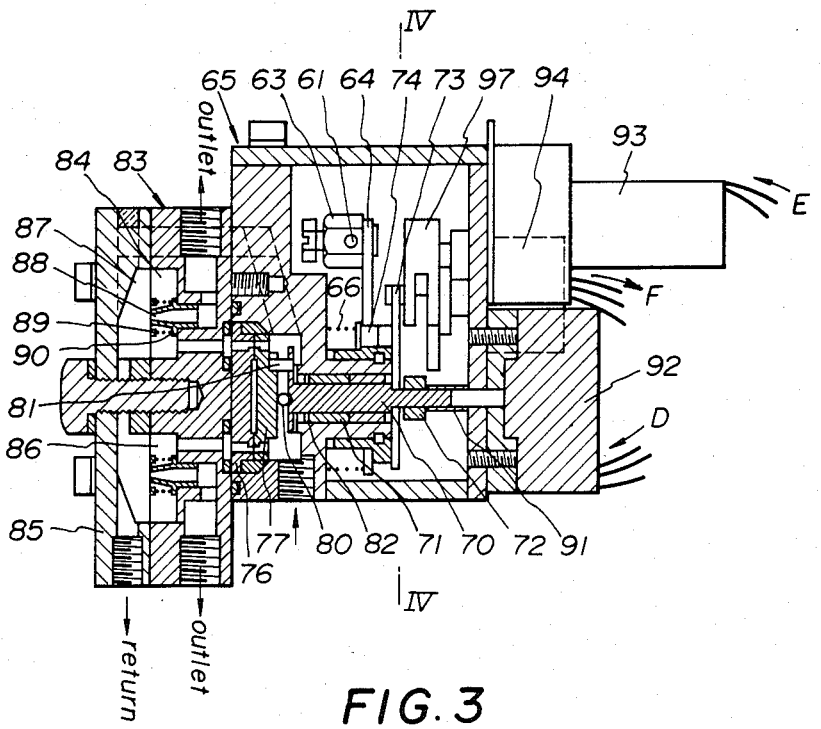
FIG. 2 is a sectional view of another preferred embodiment of the metering mechanism used in FIG. 1.
Figure 3:
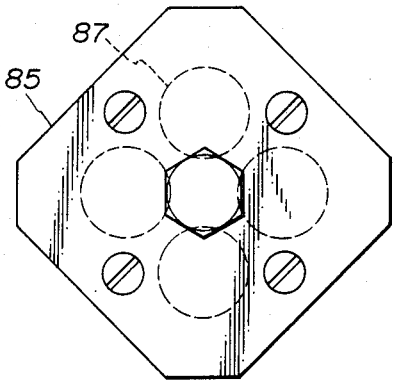
FIG. 3 is a side view of the metering mechanism shown in FIG. 2.
Figure 4:
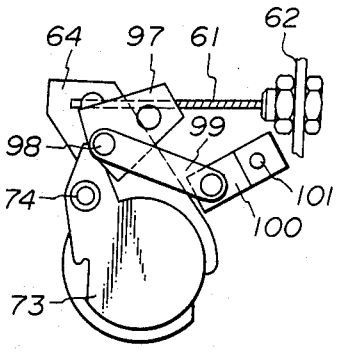
FIG. 4 is a front view of the connecting portion between an accelerator pedal and a throttle wire operated cooperatively with the accelerator pedal shown in FIG. 2.
Figure 5:
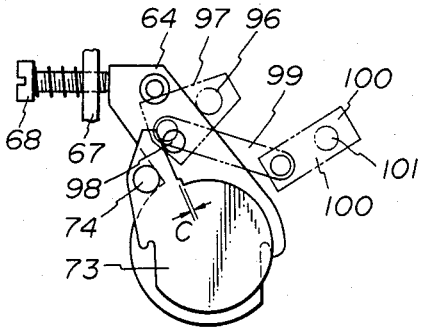
FIG. 5 is a front view of the link lever of the metering mechanism shown in FIG. 2 when disposed at its idling position.

In FIG. 2, which shows the section of the rotary metering mechanism, the command or movement of the accelerator pedal 15 as depressed by an operator is connected through a throttle wire 61 interlocked to a linkage shown in FIG. 4, at its outer cable to a bracket 62 by a suitable method and at its inner cable to a terminal 63. Since the terminal 63 is mounted at a lever 64, the latter rotates clockwise in FIGS. 4, 5 or 7 against a spring 66 set at the lever 64 and a body 65. The setting of the idling operation of the engine is selected by a set screw 68 installed at a bracket 67 fixed to the body 65 at the closing position of the lever 64, as shown in FIG. 5. The rotary shaft 70 may be smoothly rotated via a bearing 71 integrally with a lever 73 secured thereto by a nut 72 at the left external end thereof. A roller 74 is mounted at the lever 73 to connect the lever 64 to the lever 73 via a spring 75. Accordingly, the roller 74 may rotate in contact with the left side surface of the lever 64 as shown in FIG. 5.

Figure 6:
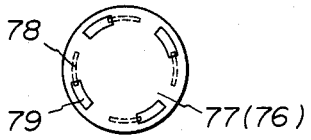
FIG. 6 is a front view of the fuel metering orifice shown in FIG. 5.
Figure 8:
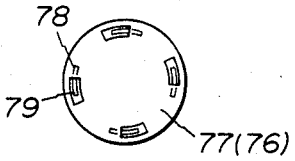
FIG. 8 is front view of the fuel metering orifice shown in FIG. 7.

The fuel is metered by a pair of stationary orifice valves 76 installed in the body 65 and a rotary valve 77 for determining the opening of the orifice upon rotation thereof with respect to the stationary orifice valve 76 in such a manner that the orifice of the valve 76 is a narrower opening 78 as shown in FIG. 6 or 8. On the other hand, the opening of the rotary valve 77 is a wider opening 79, so that the area of the portion overlapped by the openings 78 and 79 becomes the metering area to thereby form an effective metering port.

A spring 80 operates to exactly contact the orifice valve 76 with the rotary valve 77 as a pressure spring for preventing the fuel from leaking from the portion except for the metering area. The rotary valve 77 incorporates a radial groove on part thereof to engage a pawl 81 projected at the left end of the shaft 70. With this construction, the operator may directly control the metering area by depressing the accelerator pedal.

The fuel flows from the supply port to the space at the left portion of the rotary valve 77 with an oil seal 82 set to prevent the fuel from leaking from the shaft portion. Since the outer periphery of the orifice valve 76 is press-fitted into the body 65 to thereby prevent the fuel from leaking therefrom, the fuel is passed only through the metering area into the left side of the orifice valve with O-rings engaged in the passage of the fuel distributing body 83 fixed by a set screw of the body 65 and in the passage of the body 65, respectively for preventing the fuel from leaking externally therefrom and into the chamber 84 of the body 83.

As obvious from FIGS. 6 and 8, the metering orifices 78, 79 are provided at four positions (in the case of four cylinders) in such a manner that the area of the openings are accurately equal to each other within an allowable range to correspond to the cylinders of the engine.

The fuel is introduced into the chamber 84. A thin metallic plate 86 is inserted between the cover plates 85 and the distributor body 83 to thus divide the chambers 84 and 87. The fuel at the supply side is introduced through the upper passage designated by broken line of the body 65 into the chamber 87 to thereby apply the fuel pressure thereto. A nozzle 88 is press-fitted into the chamber 84 of the body 83 with a spring disposed at the outside of the nozzle 88 to form a pair with a guide ring 89 so as to pressurize the plate 86 to thereby provide a clearance between the plate 86 and the end of the nozzle 88.

With such a construction, the fuel passes through the metering area and fills the chamber 84. As the fuel in the chamber 84 becomes equal to the supply pressure, the plate 86 is deflected in a convex manner toward the left side in the amount pressurized by a spring 90 to thereby provide a clearance between the plate 86 and the nozzle 88 with the result that the fuel flows into the outlet. As a result, the fuel pressure in the chamber 84 is lowered. When the total pressure of the fuel pressure in the chamber 84 and the tension of the spring 90 becomes lower than the pressure in the chamber 87, the opening at the left end of the nozzle 88 is closed by the plate 86 to stop the flow of fuel into the outlet. This limiting cycle is continuously repeated at a rate of several hundred Hertz (Hz) to provide a stable output over a small time period on the order of second and to thus exhibit a load insensitive characteristic. In FIGS. 6 and 8, the same operations are conducted at four positions to thereby obtain the same fuel flow rate at all four positions.

A limiter mechanism for the situation where the throttle is wide open must also be provided in the same manner as for the spool valve shown in FIG. 1. In order to carry out this function, the following arrangement is provided.

The displacement of the rotary valve is connected to the rotary shaft of the potentiometer 92 through a shaft joint 91 in the same manner as the spool valve described previously. The output D of the potentiometer 92 in FIG. 2 corresponds to the output D of the potentiometer 17 in FIG. 1. Similarly, the input F from the potentiometer 18 in FIG. 1 corresponds to the output F from the potentiometer 94.

In the case where an operator depresses the accelerator pedal at its full stroke when the engine is rotated at 3,000 rpm in the same manner as described before, the computer 50 produces a command signal E to the servo motor 93 to thereby cause a lever 97 secured to the output shaft 96 of the servo motor 93 to make contact with the left upper portion of the lever 73, as shown in FIG. 5, by a stopper roller 98 mounted at the lever 97 to thereby restrict the lever 73 from rotating clockwise any further. The servo motor 93 employs a miniature motor. Thus, even if the accelerator pedal is depressed to its full stroke by the operator, an adequate metering area can be obtained with respect to the rotating speed of the engine to prevent an excessively rich fuel mixture.

Figure 7:
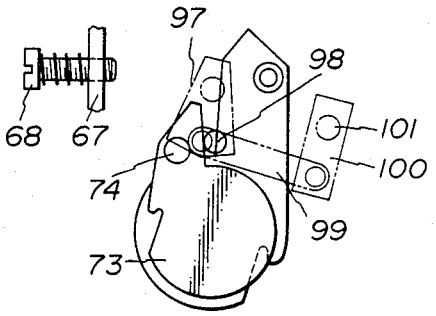
FIG. 7 is front view of the link lever when the engine is rotated at an intermediate speed such as, for example, 2,500 rpm.

FIG. 7 shows a front view of the link lever when the engine is operated. It is clearly seen that the roller 74 is separated from the side surface of the lever 64, but the roller 74 instead makes contact with the side surface of the lever 73. A connecting lever 99 connected to the lever 97 is connected to a lever 100 mounted at the shaft 101 of a potentiometer 94 for detecting the displacement of the servo motor shaft to thereby always feed back the displacement of the motor shaft as an output F to the computer 50.

In both the spool type and rotary type fuel feed mechanisms, the servo motors 19 and 93 always stand by at the position for limiting the fuel flow rate so it does not exceed the fuel flow rate when the throttle is widely opened to ensure a fuel flow rate correspond to the engine speed at that time.

FIG. 5 shows the link lever of the metering mechanism when disposed at its idling position. When the idling speed of the engine is, for example, 600 rpm, there is no possibility the that the throttle is opened wide at this engine speed. (The engine otherwise would be in a dangerous state causing damage or stalling which finally stops its operation.) Inasmuch as the minimum engine rotating speed when the throttle is widely opened is generally set at 1,000 to 1,200 rpm, the roller 98 of the limiter level stands by at the position displaced at a distance corresponding to the minimum engine idling speed. Accordingly, a gap or a clearance designated by "C" in FIG. 5 is provided between the side surface of the lever 73 and the limiter roller 98. At this time, the openings 78 and 79 are so superimposed at the metering area as shown in FIG. 6 as to form a slight fuel passing area.

In the case where the spool valve or rotary valve is employed as described above to control a mechanical opening area, the metering area limiting mechanism of any type as described above may be employed.

In addition to the direct mechanical input to the spool valve or rotary valve as described above with reference to FIGS. 1 and 2, it is also possible to convert the stroke of the accelerator pedal into an electric amplitude or signal, which is inputted into a computer, which produces its calculated result and applies it to a servo motor which thereupon drives directly the spool valve or the rotary valve.

Metering Mechanism Utilizing Electromagnetic Valve:

A metering mechanism using a static variable area control process has been described above, and a dynamic metering mechanism will now be described as an entirely different arrangement as another embodiment of the metering mechanism.

Figure 9:
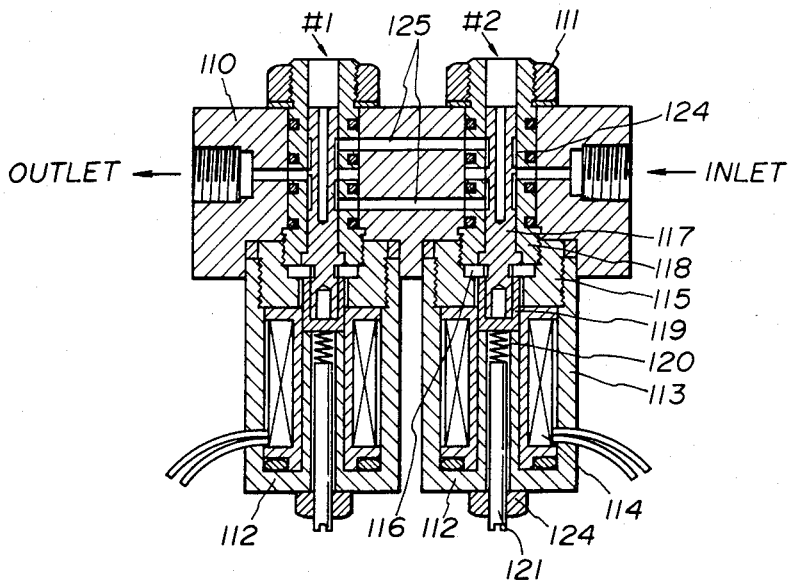
FIG. 9 is a sectional view of still another embodiment of the metering mechanism shown in FIG. 1.
Figure 10:
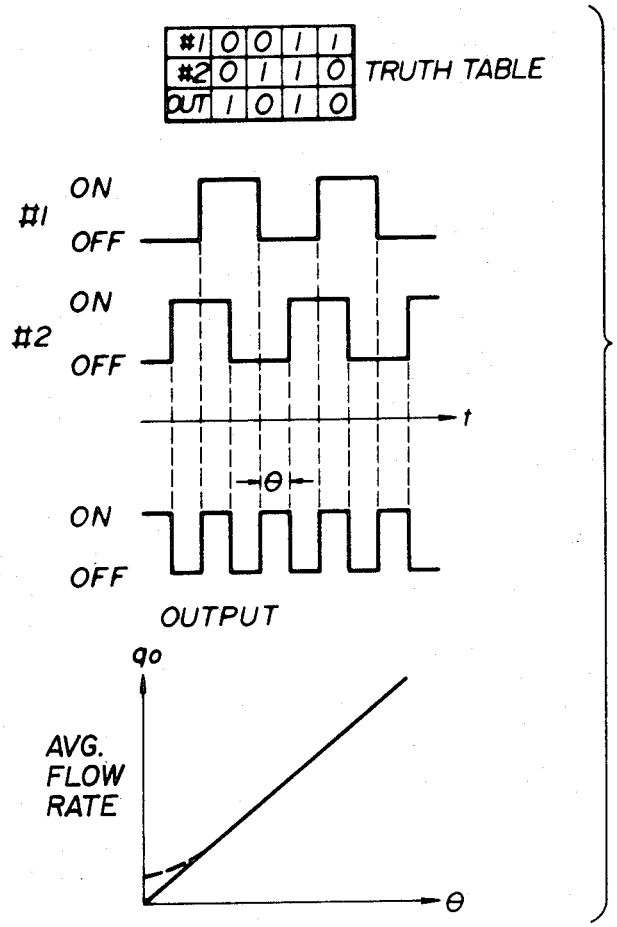
FIG. 10 is a graphical representation of the truth table, timing chart and flow characteristics of the output of the dual valve shown in FIG. 9.

FIG. 9 shows the construction of the dynamic metering mechanism, and FIG. 10 shows the input and output relations thereof.

As shown in FIG. 9, the dynamic metering mechanism comprises two spool type three-way valves driven by two sets of electromagnetic solenoids connected thereto. This three-way valves need not always be a spool type, but may also be other valve types.

Valves #1 and #2 are associated with a valve body 110 and are tightened by nuts 111 thereto. A solenoid 114 is provided in a solenoid holder 112. Into the solenoid holder 112 is screwed a valve holder 115 to thereby tighten the solenoid 114. Above the solenoid 114 a valve guide 118 contains a valve stopper 116 and a valve 117 and is screwed into the valve holder 115. A cup 119 made of magnetic material is press-fitted into the lower end of the valve 117 to move integrally with the valve 117. A spring 120 is so set to always urge the valve 117 when the solenoid 114 is not energized.

A spring tension control screw 121 is controlled via a locking nut 122 and is locked after the control. This screw 121 controls the load of the spring to ensure its adequate operation. Fuel is supplied from the inlet and it then flows into the cavity 124 of the spool. When the solenoid valve #2 is not energized, the fuel flows into the lower cavity 124. The fuel then flows through a lower passage 125 into the valve #1. When the #1 is not energized at this time, the fuel flows into the outlet.

When only the valve #2 is energized, the fuel from the inlet flows into the upper cavity 124 and through the upper passage 125 into the upper cavity of the valve #1 but does not flow into the outlet. At this time, the outlet is communicated with the lower cavity of the valve #1 and further with the lower passage of the passage 125 in the lower cavity of the valve #2. However, since the outlet is not communicated with the inlet and does not overlap with the inlet port, fuel cannot flow from either the upper or the lower passage 125 into the outlet. When the #1 is then energized inversely, fuel flows through the upper passage 125 from the inlet into the outlet. Thus, the outlet is opened. When both valves are energized simultaneously, the fuel merely flows from the inlet to the outlet.

FIG. 10 shows in an upper portion thereof the truth table relative to the operation of the two values of a logic valve type fuel metering device operating as described previously. The energization (on) and the deenergization (off) of the metering mechanism at various times is shown in the middle portion of FIG. 10, while the fuel flow rate per unit time versus the phase difference $\theta$ of the energized valves #1 and #2 is constant is shown in the lower portion of FIG. 10.

As shown in the graphical representation in the lower portion of FIG. 10, when the phase difference is low and the fuel dflow rate is low, the higher the frequency of the energization of both the valves #1 and #2 is, the better the repeatability and linearity becomes to thereby secure a high fuel flow rate accuracy. Generally, in case that $\theta>0$ and $\theta<<1$, the fuel flow linearity deteriorates as designated by a broken line in FIG. 10. This is because the rise and fall of the valves in operation takes a certain amount of time to thereby cause a delay in operation.

When the drive mode of the valves are not set at the ON and OFF operations as shown in FIG. 10 but are set at a sine curve or the like as driven via a smooth vibrating waveform, the fuel flow rate characteristic at a low flow rate becomes as designated by a broken line in the graph in FIG. 10. Accordingly, the drive mode of the valves may freely be selected to some degree. The inlet and outlet of the metering valve may be connected to the inlet and outlet of the spool valve shown in FIG. 1 as a substitute for the spool valve.

Figure 11:
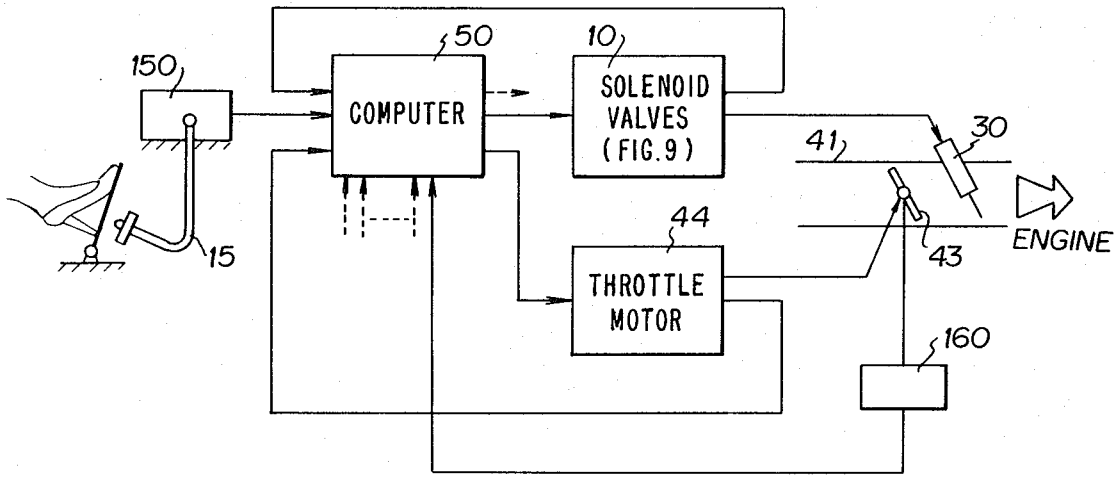
FIG. 11 is a block diagram of the electronic control fuel injection system utilizing the digital logic circuit as operated in FIG. 10.

The block diagram of the electronic control fuel injection system utilizing the digital logic valve as described previously with respect to FIG. 10 is shown in FIG. 11. As obvious from FIG. 11, an accelerator pedal 15 is not connected through a wire or a linkage as a mechanical connection, but the depressed stroke of the accelerator 15 is, for example, converted via a potentiometer 150 into an electric signal, which is then applied either to a computer 50 which calculates a required fuel flow rate signal for driving valves 10, or is converted via a voltage-to-frequency (V/F) converter (not shown) independent from the computer into a frequency signal for directly driving the valve 10 to control fuel flow to injector 30. This can be easily performed in accordance with conventional digital electronic techniques. A single point injector 30 is preferable with this arrangement from a cost performance standpoint. The fuel supply limitation, which was heretofore described, can also easily be used in this arrangement as well to control the fuel flow rate. Reference numeral 11 in FIG. 11 represents a potentiometer.

This system further incorporates an intake manifold bore 41, a throttle valve 43, a servo motor 44 and various air flow connections in the same manner as the system shown in FIG. 1, and accordingly reference is made back to the discussion of FIG. 1 for these aspects of the FIG. 11 embodiment.

The fuel metering mechanism can also easily be implemented by means of a so-called "on pulse duration controller for a solenoid type injector in an EFI system" or a "frequency controller with a constant pulse duration" which has been heretofore used, in addition to a mechanism employing an independent metering mechanism.

Advantages and Effects:

The fuel preferential fuel injection system thus constructed incorporates the following advantages:

It takes into consideration changes in the numerous parameters affecting the operating state of the engine which vary as time goes by such as speed, load, and air and fuel flow rates in establishing the running pattern of the engine. In operation, an engine is affected by repeated step ups and step downs in accordance with the depression and release of the accelerator pedal. With a conventional air flow preference system a delay in the rise and fall of fuel flow rate with such changes cannot be avoided because the fuel flow rate is determined by the air flow rate variation signal after the air flow rate is determined.

Figure 12:
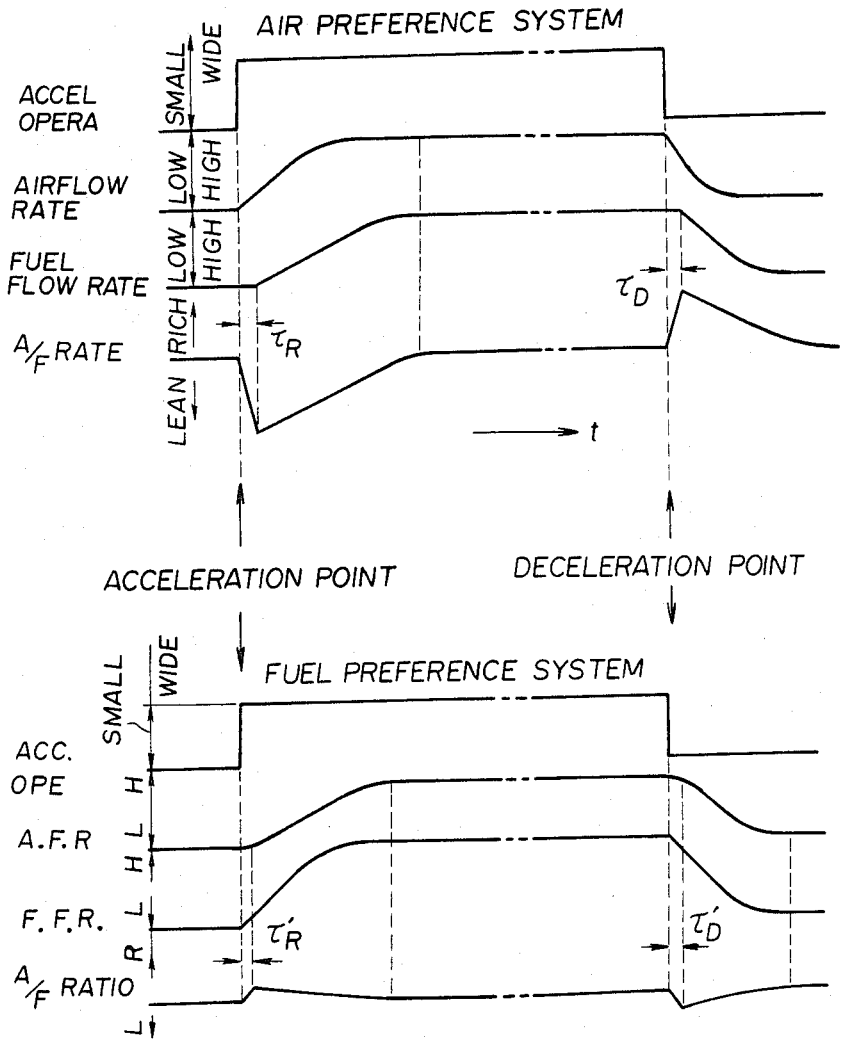
FIG. 12 is a graphical representation of the characteristic curves of the electronic control fuel injection system of this invention.

FIG. 12 shows the characteristics of the conventional air preference system in the upper portion. The air preference control system possesses a delay in rise of the fuel flow rate or delay time $\tau_R$ and similarly delay time $\tau_D$ in fall of the fuel flow rate. As a result, the air fuel ratio A/F of the air fuel mixture becomes extremely lean immediately after the engine is accelerated and becomes extremely rich immediately after the engine is decelerated as shown by the curve in the upper portion of FIG. 12. This is called the "hesitation" or "sag" of the automotive engine and is an undesired phenomena. When a delay in the drop of the fuel flow rate occurs in the automotive engine, the engine exhausts detrimental gas emissions such as HC, CO, etc. with a high density. In order to remedy this undesired phenomena, an acceleration enrichment device is typically employed to correct hesitation and the delay in the closure of the throttle valve by a dash pot or an additional air bypass is employed to correct for the increased exhaust emissions.

On the other hand, the fuel preference fuel injection system of this invention adjusts the air fuel mixture so it becomes rich immediately after the engine is accelerated, and becomes lean immediately after the engine is decelerated.

In addition, since fuel has a higher density and viscosity than air, its flow resistance is high with a corresponding lag in flow in response to a stepping control of the amount thereof applied to an engine. Accordingly, the time lag of the air flowing subsequent to the fuel may suitably be controlled to meet the fuel in the engin. Therefore, the automative engine does not have the "hesitation" or "sag" and the air fuel mixture can readily attain a desired ratio even during transient periods to obtain fuel economy and a desired low emission density. These characteristics are shown in the lower portion of FIG. 12. In this case, the delay time $\tau_R'$ in the rise of the air flow rate may be made to coincide with the fuel flow rate by suitably controlling the rise of the fuel flow rate. In case of decelerating the automotive engine, the characteristics may also be similarly controlled.

As obvious from the comparison of the conventional fuel injection system with the fuel preferential fuel injection system of this invention, the former system wastefully consumes fuel which is not contributing to driving the automobile particularly during deceleration, but the latter system reduces the fuel flow rate immediately after an operator releases the accelerator to decelerate the automobile. Even if the automotive engine consumes the same amount of fuel in its steady running state with the fuel preferential fuel injection system of the invention as compared with a conventional engine fuel system control, it can markedly improve the total fuel consumption when the automobile repeatedly accelerates and decelerates as in city driving and can also readily control harmful exhaust emissions.

Although preferred embodiments of the invention have been shown and described they are merely exemplary of the invention. Accordingly, the invention is not limited by this description but only by the scope of the claims appended hereto.

What is claimed is:

1. An electronic control fuel injection system for a spark ignition internal combustion engine for preferentially determining fuel flow rate according to the stroke of an accelerator pedal and subordinately determining airflow rate to the engine in response to the fuel flow rate and the engine operating state comprising:

an air intake passage having a throttle valve therein for supplying air to said engine;

a fuel selecting mechanism for selecting a fuel discharge amount in accordance with a depression stroke of an accelerator pedal;

an exhaust gas recirculation rate control device;

at least one fuel injector for injecting said selected fuel discharge amount into said engine;

means for detecting the amount of intake air to said engine comprising first means for providing a signal representing a pressure difference in said air intake passage on the upstream and downstream sides of said throttle valve, and a second means for providing a signal representing the actual opening position of said throttle valve;

an engine rotational speed detecting sensor;

an engine temperature sensor;

a computer for selectively receiving signals from said fuel selecting mechanism indicating a selected fuel discharge amount, from said first means for providing a signal representing said pressure difference, from said second means for providing a signal representing the actual opening position of said throttle valve and from said rotational speed and temperature sensors, for producing from the signal from said fuel selecting mechanism a first fuel supply output signal which controls the amount of fuel injected by said injector so that said selected fuel discharge amount is supplied to said engine, and for producing from said pressure difference signal, from a signal representing an injected fuel flow amount, and from the signal indicating the actual opening position of said throttle valve, a second optimum air supply amount output signal, said computer adjusting at least one of said first and second output signals in accordance with the signal from said temperature sensor, said computer further producing from the signal from said rotational speed detecting sensor a fuel limiting signal, the amount of fuel discharged by said injector being limited independently of the depression stroke of the accelerator pedal in response to said fuel limiting signal, said computer also producing a third output signal which controls said exhaust gas recirculation rate control device in response to said engine rotational speed signal and said signal representing the selected fuel discharge amount; and, a throttle valve control mechanism for setting the opening of said throttle valve according to said second output signal from said computer to provide an optimum air supply amount to said engine.

2. The electronic control fuel injection system according to claim 1, further comprising a plurality of solenoid valves which are operated by said first output signal in accordance with predetermined logic relationships to one another to vary the amount of fuel supplied to said injector.

3. The electronic control fuel injection system according to claim 1, wherein said second means for providing a signal indicating the actual opening position of said throttle valve comprises an opening detector connected to said throttle valve which provides a feedback signal to said computer.

4. The electronic control fuel injection system according to claim 3, wherein said throttle valve control mechanism comprises a DC motor.

5. The electronic control fuel injection system according to claim 1, wherein said throttle valve control mechanism comprises a stepping motor.

6. The electronic control fuel injection system according to claim 1, further comprising an atmospheric temperature sensor, and wherein said computer adjusts at least one of said first and second output signals in accordance with a signal from said atmospheric temperature sensor.

7. The electronic control fuel injection system according to claim 1, further comprising means for detecting an air to fuel ratio for said engine and wherein said computer adjusts at least one of said first and second output signals in accordance with a signal from said air to fuel ratio detecting means.

8. The electronic control fuel injection system according to claim 1, further comprising means for detecting ambient air pressure and wherein said computer adjusts at least one of said first and second output signals in accordance with a signal from said ambient air pressure detecting means.

9. The electronic control fuel injection system according to claim 1, further comprising a fuel flow control device and a fuel limiting mechanism including a servo control device for controlling movement of said fuel flow control device, said servo control device being responsive to said fuel limiting signal, said computer receiving a feedback signal from said servo control device indicating its operative position and using said feedback signal in calculating said fuel limiting signal.

10. The electronic control fuel injection system according to claim 1, further comprising a solenoid control valve for supplying fuel to said injector, said computer operating said solenoid control valve.

11. The electronic control fuel injection system as in claim 1 further comprising means for sensing whether a stoichiometric air fuel ratio is being supplied to said engine, said computer adjusting the air fuel ratio of the combustible mixture supplied to said engine in response to a signal from said stoichiometric air fuel ratio sensor.

12. The electronic fuel injection system as in claim 1 further comprising a spark advance control device, said computer supplying a spark advance control output signal to said spark advance control device in response to said signal from said fuel selecting mechanism.

13. The electronic control fuel injection system of claim 1 further comprising a catalytic converter temperature sensor, said computer adjusting said third output signal in response to a signal from said converter temperature sensor.

* * * * *